US006737644B2

(12) United States Patent
Itoi

(10) Patent No.: US 6,737,644 B2
(45) Date of Patent: May 18, 2004

(54) QUADRUPOLE MASS SPECTROMETER

(75) Inventor: Hiroto Itoi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 20 days.

(21) Appl. No.: 10/131,412

(22) Filed: Apr. 25, 2002

(65) Prior Publication Data

US 2002/0162959 A1 Nov. 7, 2002

(30) Foreign Application Priority Data

May 1, 2001 (JP) ..... 2001-133783

(51) Int. Cl.[7] ..... H01J 49/00
(52) U.S. Cl. ..... 250/292
(58) Field of Search ..... 250/281, 282, 250/290, 292

(56) References Cited

U.S. PATENT DOCUMENTS 4,329,582 A * 5/1982 French et al. ..... 250/292
5,464,975 A * 11/1995 Kirchner et al. ..... 250/283
2002/0063211 A1 * 5/2002 Hager ..... 250/292

* cited by examiner

*Primary Examiner*—John R. Lee
*Assistant Examiner*—Christopher M. Kalivoda
(74) *Attorney, Agent, or Firm*—Westerman, Hattori, Daniels & Adrian, LLP

(57) ABSTRACT

A quadrupole mass spectrometer includes: an ion source for generating ions; a quadrupole mass filter for selectively passing object ions having a predetermined mass number among the ions from the ion source; an ion detector for detecting the object ions; an ion converging lens placed between the quadrupole mass filter and the ion detector; and a voltage source for applying an optimal voltage to the ion converging lens, wherein the voltage has a polarity opposite to that of the object ions and the absolute value of the voltage is larger than that of a voltage at which the converging efficiency of the object ions is the largest. With respect to the overall S/N ratio, the optimal state is achieved when the optimal converging voltage which is greater than the maximum converging voltage is applied to the ion converging lens.

10 Claims, 3 Drawing Sheets

QUADRUPOLE MASS SPECTROMETER

The present invention relates to a quadrupole mass spectrometer.

BACKGROUND OF THE INVENTION

In a quadrupole mass spectrometer, ions generated in an ion source including various kinds of mass numbers are drawn into a quadrupole mass filter, where, among them, only ions having a certain mass number (which are referred to as object ions) can pass through. The object ions that have passed through the quadrupole mass filter are detected by an ion detector, which generates a detection signal corresponding to the number of detected ions. Most of the ions other than the object ions dissipate in the quadrupole mass filter, but energy particles including non-charged particles, such as neutrons, which are not affected by the electric field produced by the quadrupole mass filter and some charged particles other than the object ions which do not dissipate but pass through the electric field produced by the quadrupole mass filter can enter the ion detector Such energy particles constitute noise components in the detection signals. In order to improve the sensitivity of detection, it is desired to prevent these unwanted energy particles from entering the ion detector.

In conventional quadrupole mass spectrometers, various measures have been taken to avoid such non-charged particles. One is a so-called Off-Axis structure in which the ion detector is placed offset from the ion axis of the quadrupole mass filter In another structure, an ion converging lens is placed at the exit of the quadrupole mass filter, and the lens aperture is shrunk and an appropriate converging voltage is applied to the ion converging lens so that the converging efficiency for the object ions is the highest, or, in other words, the maximum amount of object ions may enter the ion detector.

Though the efficiency of introducing object ions into the ion detector is improved with those measures, noise level is not yet sufficiently suppressed, and an increase in the S/N ratio of the detection signal is still greatly needed.

SUMMARY OF THE INVENTION

Since conventional methods cannot cope with this need, the present invention provides a quite different method and apparatus for decreasing noise in the detection signal, and thus increasing its S/N ratio, which leads to an improved analyzing sensitivity of a quadrupole mass spectrometer.

In some quadrupole mass spectrometers, an ion converging lens is placed at the exit of the quadrupole mass filter to converge object ions and make as many of them as possible enter the ion detector. With long experience in designing and a profound insight into the quadrupole mass spectrometer, the inventor experimented and studied the relationship between converging voltage applied to the ion converging lens, the intensity of object ions and the intensity of noise detected by the ion detector. Through experiment and study, the inventor found that the converging efficiency of the object ions reaches its greatest efficiency at a certain maximum converging voltage. It is also found that the converging efficiency drops as the converging voltage increases from the maximum converging voltage, and the noise intensity decreases faster than the converging efficiency of the object ions as the converging voltage increases from the maximum converging voltage. That is, with respect to the overall S/N ratio, the optimal state is achieved when another certain converging voltage, or an optimal converging voltage, which is greater than the maximum converging voltage is applied to the ion converging lens.

Thus a quadrupole mass spectrometer according to the present invention includes:

- an ion source for generating ions;
- a quadrupole mass filter for selectively passing object ions having a predetermined mass number among the ions from the ion source;
- an ion detector for detecting the object ions;
- an ion converging lens placed between the quadrupole mass filter and the ion detector; and
- a voltage source for applying voltage to the ion converging lens, wherein the voltage has a polarity opposite to that of the object ions and the absolute value of the voltage is larger than that of the voltage at which the converging efficiency of the object ions is the largest.

The quadrupole mass spectrometer of the present invention and its variations are described in detail in the following description accompanied by the drawings.

BRIEF DESCRIPTION OF THE ATTACHED DRAWINGS

DESCRIPTION OF A PREFERRED EMBODIMENT

Figure 1:
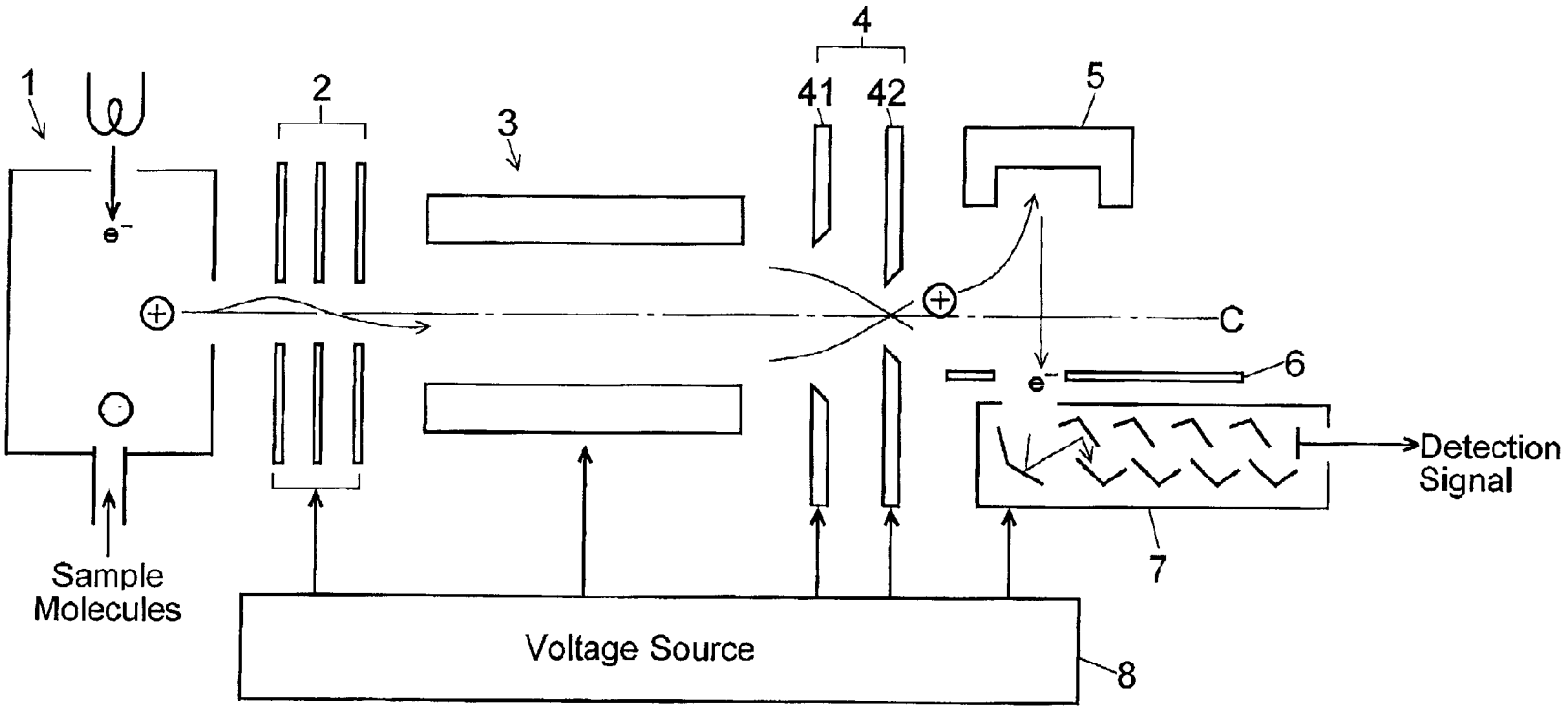
FIG. 1 shows a construction of a quadrupole mass spectrometer embodying the present invention.

FIG. 1 shows the main part of a quadrupole mass spectrometer embodying the present invention. In an analyzing chamber (not shown), the ion source 1, the first ion converging lens 2, the quadrupole mass filter 3, and the second ion converging lens 4, which corresponds to the ion converging lens mentioned above, lie along the ion axis C. After the second ion converging lens 4, an ion conversion dynode 5 and a secondary electron multiplier 7 are provided opposite each other with the ion axis C between them. A shield electrode 6 is placed at the entrance of the electron multiplier 7. The ion conversion dynode 5 and the secondary electron multiplier 7 constitute the ion detector mentioned above. The analyzing chamber is evacuated when it is used.

The second ion converging lens 4 is a so-called bipolar type lens which includes two ion lens electrodes: i.e., a first lens electrode 41 and a second lens electrodes 42. The first lens electrode 41 has an aperture whose diameter is half to almost the same as that of the circle enclosed by the four rods of the quadrupole mass filter 3 in order to admit as many object ions as possible. The second lens electrode 42 has an aperture of a smaller diameter than that of the first lens electrode 41 in order to shut off energy particles which create noise in the ion detector.

In the quadrupole mass spectrometer constructed as above, molecules or atoms of a sample, which flows out of a column of a gas chromatograph provided before the ion source 1, for example, are ionized in the ion source 1 by, for example, the electron impact method. Besides the electron impact method, the ion source 1 may use the chemical ionizing method or any other ionizing method. Various kinds of ions thus generated are drawn out of the ion source 1, converged and accelerated by the ion converging lens 2, and are propelled to the space around the longitudinal axis (ion axis) of the quadrupole mass filter 3. The quadrupole mass filter 3 has four rod electrodes (only two among four are shown in FIG. 1), and two neighboring rod electrodes are applied with the voltages of $\pm(U+V \cos \omega t)$, that is, the phases of the voltages are shifted 180° to each other, from the voltage source 8.

The various ions sent to the quadrupole mass filter 3 oscillate according to the electric field produced by the voltages applied to the rod electrodes. Among them, ions having a certain mass number corresponding to the values of U and V can pass through the space around the ion axis C, and other ions diverge from the ion axis C and dissipate. The ions (object ions) that have passed through the quadrupole mass filter 3 pass through the aperture of the first lens electrode 41 where they converge toward the aperture of the second lens electrode 42.

The voltages applied to the first and second lens electrodes 41 and 42 for adequately converging the ions will be described later. To the conversion dynode 5 is applied a negative high voltage when positive ions (cations) are to be detected, and a positive high voltage when negative ions (anions) are to be detected.

The movement of the ions when ions, cations for example, are to be detected is as follows. Ions that have passed through the quadrupole mass filter 3 pass through and are converged by the first and second converging lens electrodes 41 and 42 are attracted by the voltage applied to the conversion dynode 5 and change their path as shown in FIG. 1 to collide with the conversion dynode 5. As they collide, secondary electrons ($e^-$ in FIG. 1) are given off from the conversion dynode 5, and the secondary electrons fly downward in FIG. 1 toward the secondary electron multiplier 7. The secondary electrons are augmented in the secondary electron multiplier 7, so that a detection signal corresponding to the number of the original secondary electrons entering secondary electron multiplier 7, or the number of ions that have reached the conversion dynode 5, is obtained.

In conventional quadrupole mass spectrometers, the voltage applied to the ion converging lens 4 is normally set at such a value where the ion converging efficiency is maximum, or where the detection signal of the secondary electron multiplier 7 is maximum. However, in the quadrupole mass spectrometer according to the present invention, the voltage applied to the ion converging lens is determined as follows.

Figure 2:
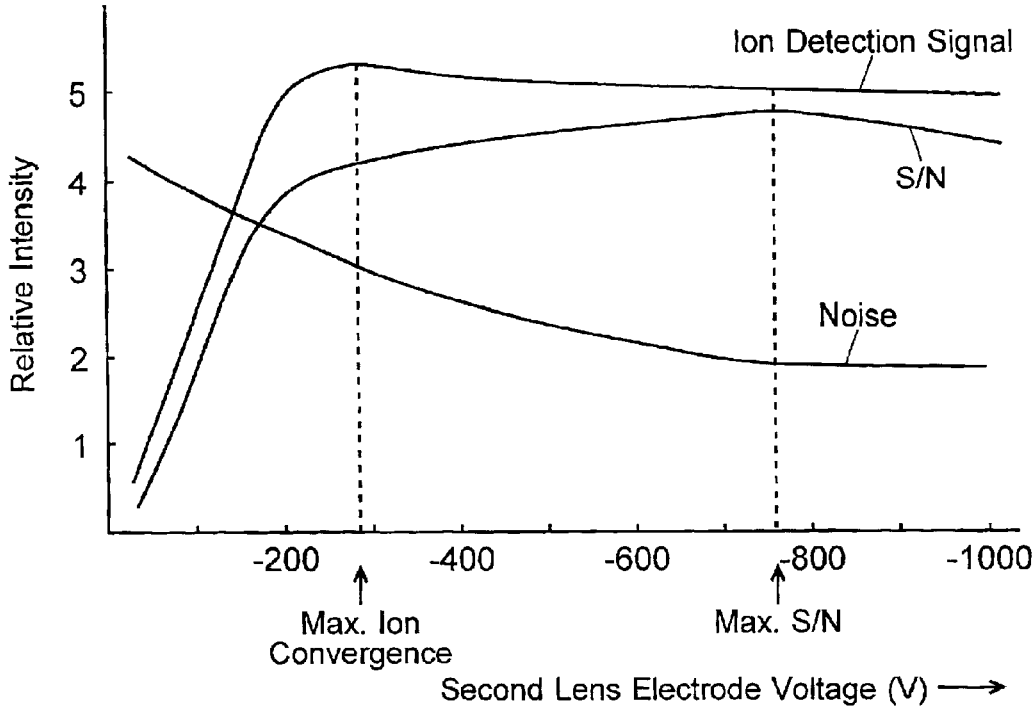
FIG. 2 is a graph showing the relationship between the voltage applied to the second lens electrode 42 and the magnitude of ion detection signal and noise.

FIG. 2 is a graph showing results of experiments of the quadrupole mass spectrometer of the present embodiment conducted by the inventor. The graph shows the relationship between the voltage applied to the second lens electrode 42 and the magnitude of ion detection signal and noise. In this case, the voltage applied to the first lens electrode 41 is set almost equal to the central value of the voltage applied to the quadrupole mass filter 3, and cations are supposed to be detected. It is apparent in FIG. 2 that the ion detection signal reaches its maximum at the second lens electrode voltage of −280V, and then it gradually decreases as the absolute value of the voltage increases. On the other hand, the magnitude of noise is not minimum at the voltage of maximum ion detection signal (or maximum ion converging efficiency), but it further decreases as the absolute value of the voltage is increased with a rate surpassing that of the decrease in the abovementioned ion detection signal.

That is, the conventional method in which the voltage is determined to maximize the ion converging efficiency is meaningful when the ion detection signal is intended to be maximized. But it is inadequate when the S/N ratio is intended to be maximized. The inventor investigated the phenomenon and found that the S/N ratio becomes maximum when the absolute value of the voltage is further increased. In the case of FIG. 2, the S/N ratio is maximum at about −750V. When, in the case of FIG. 1, voltage of that value is applied from the voltage source 8 to the second lens electrode 42, the S/N ratio of the detection signal given out of the secondary electron multiplier 7 becomes maximum. When the voltage is further increased, the S/N ratio gradually decreases, and the voltage difference between the second lens electrode 42 and the conversion dynode 5 becomes insufficient to bend the trajectory of ions for pushing the ions toward the conversion dynode 5. As a result, the ion detecting efficiency deteriorates dramatically. Thus, in this case, the lower limit of the absolute value of favorable voltage is about 280V, and the upper limit is determined by the voltage applied to the conversion dynode or by a value relating to the voltage.

The mechanism of the phenomenon that the magnitude of noise decreases when the voltage to the ion converging lens 4 is set larger than the value at which the ion converging efficiency is maximum is unexplained, but it is assumed as follows.

When uncharged particles pass through the quadrupole mass filter 3 and the ion converging lens 4, they are not affected by the electric field produced by the ion converging lens 4 and the conversion dynode 5. Thus the change in the voltage applied to the ion converging lens 4 has little influence on the change in the magnitude of noise. When, however, undesirable charged particles other than the object ions pass through the ion converging lens 4, they tend to change their trajectory due to the electric field produced by the conversion dynode 5 if their kinetic energy is small. This results in more noise. When, in this case, the voltage to the ion converging lens 4 is increased, the undesirable charged particles are accelerated and propelled to the space between the conversion dynode 5 and the secondary electron multiplier 7. As a result, they bear less influence from the electric field produced by them, and do not enter them, which yields less noise.

As described above, the S/N ratio of the detection signal is increased, and the sensitivity of analysis is improved by the quadrupole mass spectrometer according to the present embodiment.

It should be noted that the values appearing in FIG. 2 depend on the specific structure of the embodiment. Thus it is important to detect such a value of voltage where the S/N ratio is maximum for every apparatus, and adjust the voltage source 8 to produce voltage of the value or around the value.

Figure 3:
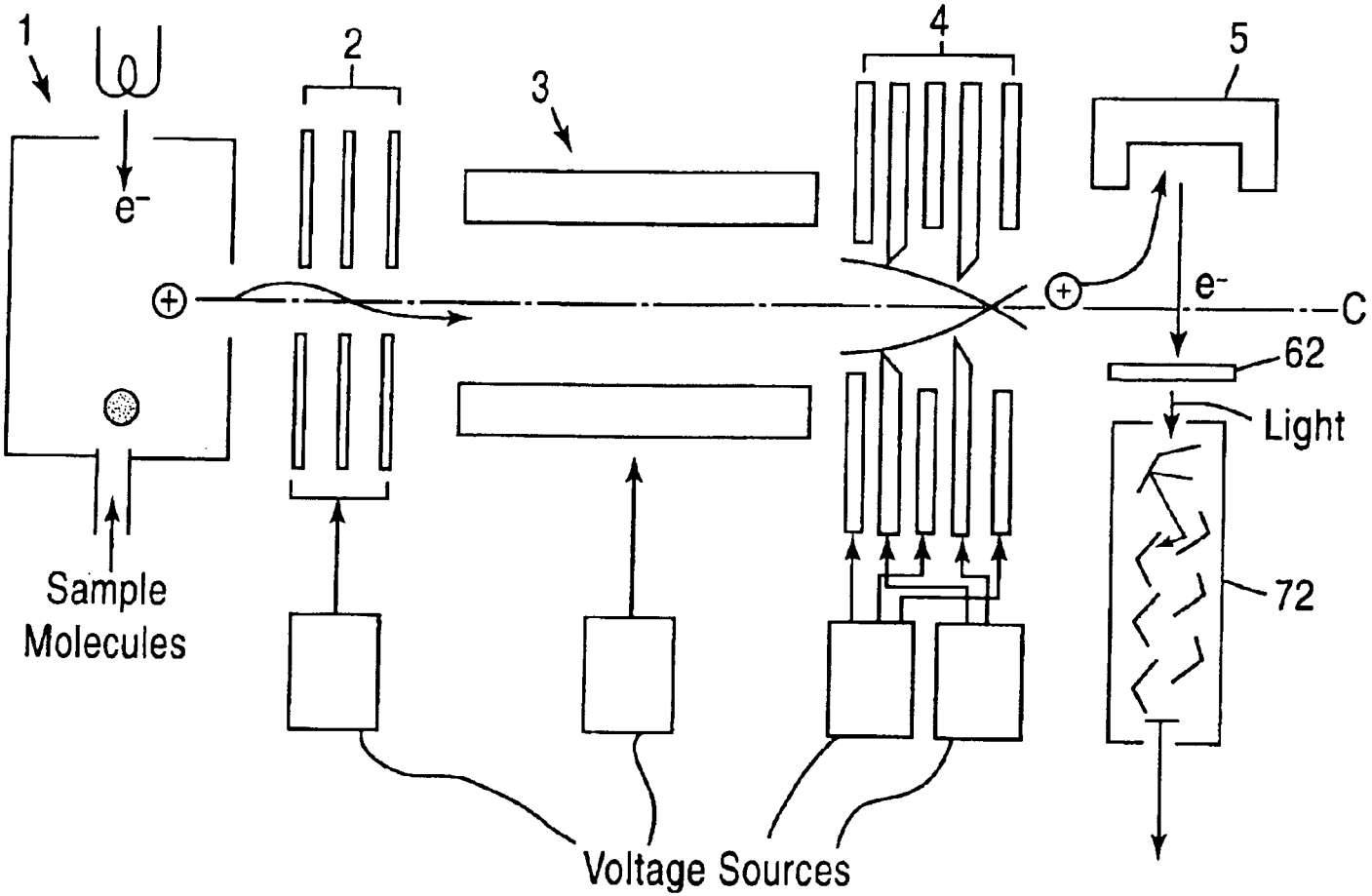
FIG. 3 is a construction of another quadrupole mass spectrometer embodying the present invention.

In the above embodiment, cations are supposed to be detected. When anions are to be detected, the same method can be used only by reversing the polarity of the voltage. Every element may be constructed otherwise in the embodiment. For example, the ion converging lens 4 maybe constructed other than described above, as long as the ions are converged by applying a voltage. It maybe a so-called einzel type using three or more lens electrodes, for example, as shown in FIG. 3. In such cases, the pertinent voltage is applied to at least one of the second to the last lens electrode. In the case of FIG. 3, five lens electrodes are provided and the pertinent voltage is applied to the second and fourth lens electrodes. When only the first three lens electrodes, among five, are used, the second lens electrode is applied with the voltage. The ion detector may not use a conversion dynode 5. A combination of a scintillator 62 and a photodetector 72 may replace the shield electrode 6 and the secondary electron multiplier 7, as shown in FIG. 3.

For applying a voltage to the ion converging lens, an independent voltage source that applies voltage exclusively to the ion converging lens may be used. The construction can be made simpler by sharing the high voltage applied to the conversion dynode or to the secondary electron multiplier with the ion converging lens. It is further possible to share the voltage with the ion converging lens 2 before the quadrupole mass filter.

What is claimed is:

1. A quadrupole mass spectrometer comprising:

an ion source for generating ions;

a quadrupole mass filter for selectively passing object ions having a predetermined mass number among the ions from the ion source;

an ion detector for detecting the object ions;

an ion converging lens placed between the quadrupole mass filter and the ion detector; and a voltage source for applying a voltage to the ion converging lens, wherein the voltage has a polarity opposite to that of the object ions and an absolute value of the voltage is larger than that of a voltage at which a converging efficiency of the object ions is the largest.

2. The quadrupole mass spectrometer according to claim 1, wherein the ion converging lens is a bipolar type composed of two lens electrodes, and the voltage source applies the voltage to a latter one of the two lens electrodes.

3. The quadrupole mass spectrometer according to claim 1, wherein the ion converging lens is an einzel type composed of three or more lens electrodes, and the voltage source applies the voltage to at least one of the second to the last one of the lens electrodes.

4. The quadrupole mass spectrometer according to claim 1, wherein the ion detector includes a conversion dynode and a secondary electron multiplier having a shield electrode placed opposite each other with an ion axis between them.

5. The quadrupole mass spectrometer according to claim 1, wherein the ion detector includes a scintillator and a photodetector.

6. The quadrupole mass spectrometer according to claim 1, wherein the voltage source applies a voltage to, in addition to the ion converging lens, at least one of the other components of the quadrupole mass spectrometer.

7. The quadrupole mass spectrometer according to claim 1, wherein the voltage source applies the voltage exclusively to the ion converging lens.

8. In a quadrupole mass spectrometer comprising:

an ion source for generating ions;

a quadrupole mass filter for selectively passing object ions having a predetermined mass number among the ions from the ion source;

an ion detector for detecting the object ions; and an ion converging lens placed between the quadrupole mass filter and the ion detector, a method of increasing an S/N ratio of a detection signal of the ion detector by applying a voltage to the ion converging lens, wherein the voltage has a polarity opposite to that of the object ions and the absolute value of the voltage is larger than that of a voltage at which the converging efficiency of the object ions is the largest.

9. The method according to claim 8, wherein the ion converging lens is a bipolar type composed of two lens electrodes, and the voltage is applied to a latter one of the two lens electrodes.

10. The method according to claim 8, wherein the ion converging lens is an einzel type composed of three or more lens electrodes, and the voltage is applied to at least one of the second to the last one of the lens electrodes.

* * * * *